US009606463B2

(12) United States Patent
Tasaki et al.

(10) Patent No.: US 9,606,463 B2
(45) Date of Patent: Mar. 28, 2017

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Mona Tasaki, Kanagawa (JP); Fusako Kiyono, Kanagawa (JP); Shuji Sato, Kanagawa (JP); Emi Matsushita, Kanagawa (JP); Shintaro Anno, Kanagawa (JP); Keita Yamamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/933,742

(22) Filed: Nov. 5, 2015

(65) Prior Publication Data

US 2016/0349638 A1 Dec. 1, 2016

(30) Foreign Application Priority Data

May 26, 2015 (JP) ..... 2015-106748

(51) Int. Cl.

| | |
|---|---|
| ***G03G 9/087*** | (2006.01) |
| ***G03G 15/08*** | (2006.01) |
| ***G03G 9/093*** | (2006.01) |
| ***G03G 9/08*** | (2006.01) |

(52) U.S. Cl.

CPC ..... *G03G 9/087* (2013.01); *G03G 9/0827* (2013.01); *G03G 9/093* (2013.01); *G03G 15/08* (2013.01)

(58) Field of Classification Search

CPC ..... G03G 9/087; G03G 9/0827; G03G 9/093; G03G 15/08; G03G 9/08797; G03G 9/08755; G03G 9/08795; G03G 9/0819

See application file for complete search history.

(56) References Cited

U.S. PATENT DOCUMENTS

| | | | | |
|---|---|---|---|---|
| 6,323,354 | B1 * | 11/2001 | Moore | A23L 1/3008 426/74 |
| 2010/0203441 | A1 | 8/2010 | Kataoka et al. | |
| 2011/0053073 | A1 * | 3/2011 | Isono | G03G 9/0806 430/108.3 |
| 2013/0011774 | A1 * | 1/2013 | Kamiwaki | G03G 9/0821 430/105 |
| 2014/0349228 | A1 | 11/2014 | Kadonome et al. | |

FOREIGN PATENT DOCUMENTS

| | | | |
|---|---|---|---|
| JP | 2009-300906 | A | 12/2009 |
| JP | 2010-160229 | A | 7/2010 |
| JP | 2010-185999 | A | 8/2010 |
| JP | 2014-178531 | A | 9/2014 |
| JP | 2014-228763 | A | 12/2014 |
| JP | 2015-1536 | A | 1/2015 |
| JP | 2015-25992 | A | 2/2015 |

* cited by examiner

*Primary Examiner* — Sandra Brase
(74) *Attorney, Agent, or Firm* — Sughrue Mion, PLLC

(57) ABSTRACT

An electrostatic-image developing toner contains toner particles and particles of a metallic salt of a fatty acid deposited on the toner particles. The particles of the metallic salt of the fatty acid contain 0.0035% to 0.07% by mass of sulfur element.

19 Claims, 2 Drawing Sheets

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2015-106748 filed May 26, 2015.

BACKGROUND

Technical Field

The present invention relates to electrostatic-image developing toners, electrostatic image developers, and toner cartridges.

SUMMARY

According to an aspect of the invention, there is provided an electrostatic-image developing toner containing toner particles and particles of a metallic salt of a fatty acid deposited on the toner particles. The particles of the metallic salt of the fatty acid contain 0.0035% to 0.07% by mass of sulfur element.

BRIEF DESCRIPTION OF THE DRAWINGS

Exemplary embodiments of the present invention will be described in detail based on the following figures, wherein.

DETAILED DESCRIPTION

Figure 1:
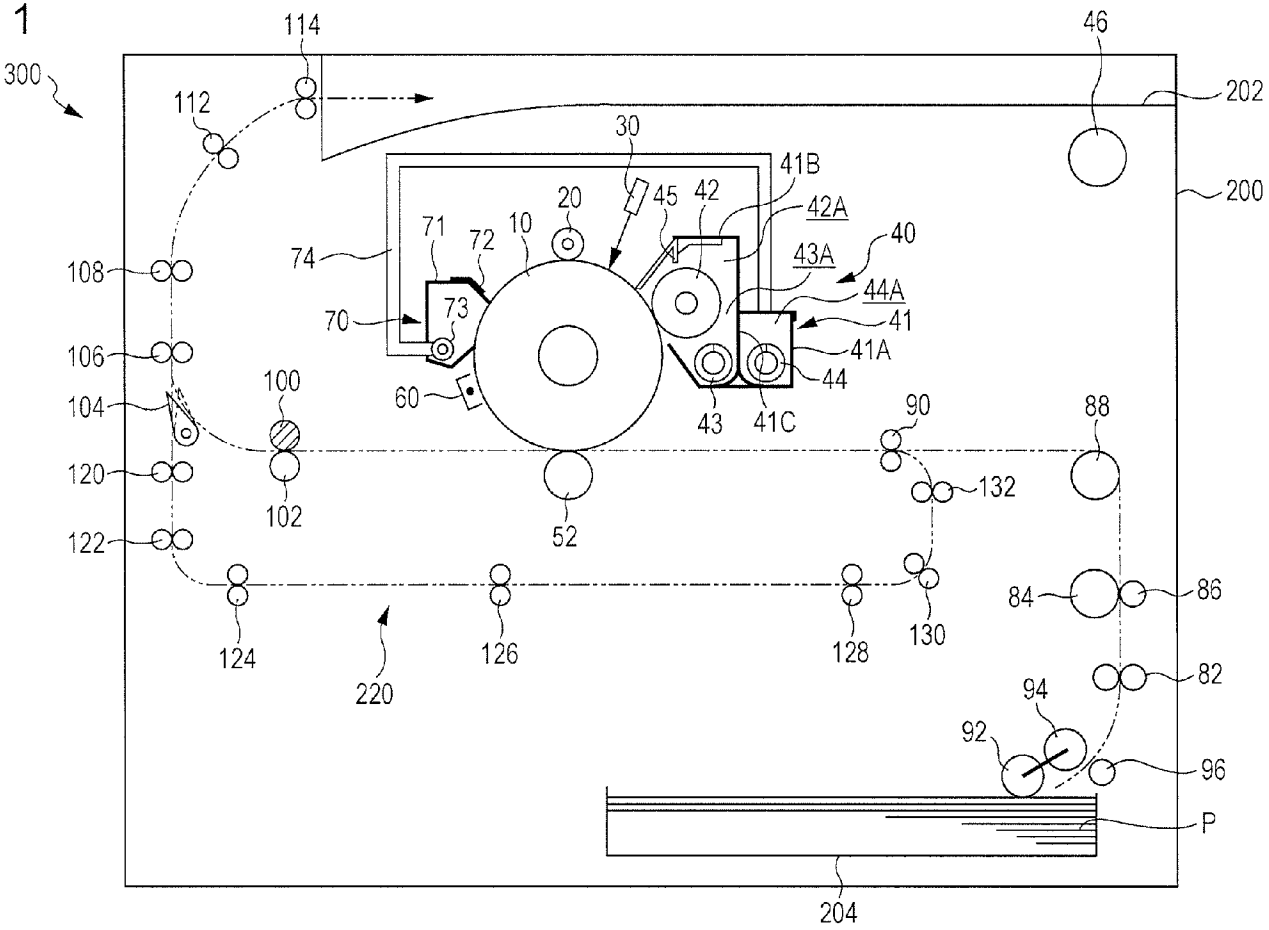
FIG. 1 is a schematic view of an example of an image-forming apparatus according to an exemplary embodiment of the present invention.

Exemplary embodiments of the present invention will now be described. The following exemplary embodiments and examples are for illustration purposes only and are not intended to limit the scope of the invention.

As used herein, electrostatic-image developing toners are also referred to as "toner", and electrostatic image developers are also referred to as "developer".

Electrostatic-Image Developing Toner

An electrostatic-image developing toner according to an exemplary embodiment of the present invention contains toner particles and particles of a metallic salt of a fatty acid deposited on the toner particles. The particles of the metallic salt of the fatty acid contain 0.0035% to 0.07% by mass of sulfur element.

Particles of metallic salts of fatty acids such as zinc stearate particles are known for use as external additives in toners. Particles of a metallic salt of a fatty acid are transferred from toner particles to a surface of an image carrier and function as a lubricant between the image carrier and a blade for cleaning the image carrier (hereinafter referred to as "cleaning blade") to reduce the wear of the cleaning blade.

However, when images are formed using a toner containing particles of a metallic salt of a fatty acid, the cleaning blade may wear unevenly in the axial direction (in the axial direction of the image carrier, which is perpendicular to the moving direction of the image carrier), and the entire cleaning blade may wear more quickly than expected. A possible mechanism is as follows.

The particles of the metallic salt of the fatty acid are believed to be positively charged by friction in the developing unit because of their constituent material. The particles of the metallic salt of the fatty acid are therefore easily transferred to the non-image region of the surface of the image carrier if the image-forming apparatus uses a negatively chargeable toner and to the image region of the surface of the image carrier if the image-forming apparatus uses a positively chargeable toner. This results in an uneven distribution of the particles of the metallic salt of the fatty acid in the surface of the image carrier in the axial direction, whether the image-forming apparatus uses a negatively chargeable toner or a positively chargeable toner. If the image-forming apparatus uses a positively chargeable toner, the particles of the metallic salt of the fatty acid are transferred to a transfer medium together with the toner particles and thus remain on the surface of the image carrier in smaller amounts than expected.

If the particles of the metallic salt of the fatty acid are unevenly distributed in the surface of the image carrier, the cleaning blade wears more in a region where the particles of the metallic salt of the fatty acid remain in smaller amounts.

If the particles of the metallic salt of the fatty acid are unevenly distributed in the surface of the image carrier in the axial direction, the cleaning blade undergoes axial strain during contact with the surface of the image carrier. This adds an unexpected load on the cleaning blade and thus promotes the wear of the entire cleaning blade.

If the particles of the metallic salt of the fatty acid remain on the surface of the image carrier in smaller amounts than expected in the first place, the cleaning blade wears more than expected.

Thus, when images are formed using a toner containing particles of a metallic salt of a fatty acid, the cleaning blade may wear unevenly in the axial direction, and the entire cleaning blade may wear more quickly than expected.

To address the foregoing problem, particles of a metallic salt of a fatty acid containing 0.0035% to 0.07% by mass of sulfur element are used as an external additive in this exemplary embodiment. Although the mechanism is not fully understood, it is believed that particles of a metallic salt of a fatty acid containing sulfur element in an amount within the above range are less easily charged by friction because of their reduced tendency to be positively charged by friction; that is, such particles of a metallic salt of a fatty acid are more electrically neutral. The fact that elemental sulfur tends to be negatively charged by friction suggests that the sulfur element present in the particles of the metallic salt of the fatty acid shifts their triboelectric charging tendency from positive to neutral.

Since particles of a metallic salt of a fatty acid containing sulfur element in an amount within the above range are less easily charged by friction, they may be transferred from the toner particles to the surface of the image carrier without being localized in the image region or the non-image region. The particles of the metallic salt of the fatty acid may thus be distributed over the entire length of the image carrier and function as a lubricant between the image carrier and the cleaning blade. According to this exemplary embodiment, therefore, the wear of the cleaning blade may be reduced.

The electrostatic-image developing toner according to this exemplary embodiment will now be described in greater detail.

Particles of Metallic Salt of Fatty Acid

The particles of the metallic salt of the fatty acid used as an external additive in the toner according to this exemplary embodiment contain 0.0035% to 0.07% by mass of sulfur element. A sulfur element content of less than 0.0035% by mass or more than 0.07% by mass promotes the wear of a cleaning blade. If the sulfur element content is less than 0.0035% by mass, the particles of the metallic salt of the fatty acid tend to be positively charged by friction in a developing unit. If the sulfur element content is more than 0.07% by mass, the particles of the metallic salt of the fatty acid have low lubrication performance. Accordingly, the sulfur element content of the particles of the metallic salt of the fatty acid is 0.0035% to 0.07% by mass, preferably 0.005% to 0.05% by mass.

Sulfur element may be incorporated into the particles of the metallic salt of the fatty acid, for example, by adding a sulfur-element containing compound during a step of manufacturing a metallic salt of a fatty acid (e.g., a saponification step) or during a step of pulverizing a solid metallic salt of a fatty acid into particles. The sulfur element content of the particles of the metallic salt of the fatty acid may be controlled depending on the amount of sulfur-element containing compound added.

Examples of sulfur-element containing compounds used to incorporate sulfur element into the particles of the metallic salt of the fatty acid include metal sulfates, alkylthiols, alkenylthiols, and metal alkyl sulfonates. In this exemplary embodiment, for example, a metal sulfate may be added during a saponification step in which a fat is saponified to manufacture a metallic salt of a fatty acid.

If the sulfur-element containing compound is a metal sulfate, the metal that forms the metal sulfate may be the same as the metal that forms the metallic salt of the fatty acid. That is, the sulfur element present in the particles of the metallic salt of the fatty acid may be derived from a metal sulfate containing the same metal as the metallic salt of the fatty acid present in the particles of the metallic salt of the fatty acid.

For example, if the metal that forms the metallic salt of the fatty acid present in the particles of the metallic salt of the fatty acid is zinc, the metal sulfate added to incorporate sulfur element may be zinc sulfate. As another example, if the metal that forms the metallic salt of the fatty acid present in the particles of the metallic salt of the fatty acid is calcium, the metal sulfate added to incorporate sulfur element may be calcium sulfate.

The fatty acid that forms the metallic salt of the fatty acid present in the particles of the metallic salt of the fatty acid may be either a saturated fatty acid or an unsaturated fatty acid and may contain any number of carbon atoms. Examples of fatty acids that form the metallic salt of the fatty acid include stearic acid, lauric acid, linoleic acid, oleic acid, palmitic acid, myristic acid, caprylic acid, and caproic acid.

Examples of metals that form the metallic salt of the fatty acid present in the particles of the metallic salt of the fatty acid include zinc, calcium, barium, magnesium, aluminum, lithium, potassium, and iron.

For example, metal stearates and metal laurates may be used as the metallic salt of the fatty acid present in the particles of the metallic salt of the fatty acid because of their lubrication performance, compound stability, and availability.

Examples of metal stearates present in the particles of the metallic salt of the fatty acid include zinc stearate, calcium stearate, barium stearate, magnesium stearate, aluminum stearate, lithium stearate, potassium stearate, and iron stearate.

Examples of metal laurates present in the particles of the metallic salt of the fatty acid include zinc laurate, calcium laurate, barium laurate, magnesium laurate, aluminum laurate, lithium laurate, potassium laurate, and iron laurate.

For example, zinc stearate may be used as the metallic salt of the fatty acid present in the particles of the metallic salt of the fatty acid because of its lubrication performance, compound stability, and availability.

The particles of the metallic salt of the fatty acid preferably have a volume average particle size of 0.1 to 10 μm, more preferably 0.5 to 3 μm.

The particles of the metallic salt of the fatty acid are preferably present in an amount of 0.02 to 1 part by mass, more preferably 0.02 to 0.2 part by mass, per 100 parts by mass of the toner particles.

Toner Particles

The toner particles contain, for example, a binder resin and optionally a colorant, a release agent, and other additives.

Binder Resin

Examples of binder resins include vinyl resins made of homopolymers or copolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Other examples of binder resins include non-vinyl resins such as epoxy resins, polyester resins, polyurethane resins, polyamide resins, cellulose resins, polyether resins, and modified rosins; mixtures of these non-vinyl resins with the above vinyl resins; and graft copolymers of these non-vinyl resins with vinyl monomers.

These binder resins may be used alone or in combination.

For example, the binder resin may be a polyester resin. Examples of polyester resins include polycondensates of polycarboxylic acids with polyhydric alcohols.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower (e.g., $C_1$-$C_5$) alkyl esters thereof. For example, aromatic dicarboxylic acids may be used.

These dicarboxylic acids may be used in combination with bridged or branched carboxylic acids having a functionality of three or more. Examples of carboxylic acids having a functionality of three or more include trimellitic acid, pyromellitic acid, and anhydrides and lower (e.g., $C_1$-$C_5$) alkyl esters thereof.

These polycarboxylic acids may be used alone or in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Preferable polyhydric alcohols include aromatic diols and alicyclic diols, more preferably aromatic diols.

These diols may be used in combination with bridged or branched polyhydric alcohols having a functionality of three or more. Examples of polyhydric alcohols having a functionality of three or more include glycerol, trimethylolpropane, and pentaerythritol.

These polyhydric alcohols may be used alone or in combination.

The polyester resin preferably has a glass transition temperature (Tg) of 50° C. to 80° C., more preferably 50° C. to 65° C.

The glass transition temperature may be determined from a differential scanning calorimetry (DSC) curve obtained by DSC. More specifically, the glass transition temperature (Tg) may be determined as the extrapolated glass transition onset temperature defined in the "Determination of Glass Transition Temperature" section of JIS K 7121-1987 "Testing Methods for Transition Temperatures of Plastics".

The polyester resin preferably has a weight average molecular weight (Mw) of 5,000 to 1,000,000, more preferably 7,000 to 500,000. The polyester resin may have a number average molecular weight (Mn) of 2,000 to 100,000. The polyester resin preferably has a molecular weight distribution Mw/Mn of 1.5 to 100, more preferably 2 to 60.

The weight average molecular weight and the number average molecular weight may be determined by gel permeation chromatography (GPC) as follows. GPC measurements are performed on a Tosoh HLC-8120 GPC system equipped with a Tosoh TSKgel Super HM-M column (15 cm) using tetrahydrofuran (THF) as an eluent and are calibrated with a molecular weight calibration curve obtained from monodisperse polystyrene standards to determine the weight average molecular weight and the number average molecular weight.

The polyester resin may be prepared by known processes. For example, the polyester resin may be prepared by performing a polymerization reaction at 180° C. to 230° C., optionally while removing water and alcohol produced during condensation from the reaction system under reduced pressure.

If any starting monomer is insoluble or immiscible at the reaction temperature, it may be dissolved using a high-boiling solvent as a solubilizer. In this case, the polycondensation reaction is performed while distilling off the solubilizer. If a copolymerization reaction is performed using a poorly immiscible monomer, it may be condensed with an acid or alcohol to be polycondensed therewith before being polycondensed with the major ingredients.

The binder resin is preferably present in an amount of, for example, 40% to 95%, more preferably 50% to 90%, even more preferably 60% to 85%, of the total mass of the toner particles.

Colorant

Examples of colorants include pigments such as carbon black, chrome yellow, hansa yellow, benzidine yellow, threne yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

Optionally, the colorant may be surface-treated or used in combination with dispersants. The colorant may be a combination of different colorants.

The colorant is preferably present in an amount of, for example, 1% to 30%, more preferably 3% to 15%, of the total mass of the toner particles.

Release Agent

Non-limiting examples of release agents include hydrocarbon waxes; natural waxes such as carnauba wax, rice wax, and candelilla wax; synthetic, mineral, and petroleum waxes such as montan wax; and ester waxes such as fatty acid esters and montanic acid esters.

The release agent preferably has a melting temperature of 50° C. to 110° C., more preferably 60° C. to 100° C.

The melting temperature may be determined from a DSC curve obtained by DSC as the melting peak temperature defined in the "Determination of Melting Temperature" section of JIS K 7121-1987 "Testing Methods for Transition Temperatures of Plastics".

The release agent is preferably present in an amount of, for example, 1% to 20%, more preferably 5% to 15%, of the total mass of the toner particles.

Other Additives

Examples of other additives include known additives such as magnetic materials, charge control agents, and inorganic powders. These additives serve as internal additives in the toner particles.

Properties of Toner Particles

The toner particles may be single-layer toner particles or core-shell toner particles including a core (core particle) and a coating (shell layer) covering the core. For example, the toner particles may be core-shell toner particles including a core containing a binder resin and other optional additives such as colorants and release agents and a coating containing a binder resin.

The toner particles preferably have a volume average particle size (D50v) of 2 to 10 μm, more preferably 4 to 8 μm.

The various average particle sizes and particle size distribution indices of the toner particles may be determined on a Coulter Multisizer II (Beckman Coulter, Inc.) using Isoton-II (Beckman Coulter, Inc.) as an electrolyte.

For measurement, 0.5 to 50 mg of a test sample is added to 2 mL of a 5% by mass aqueous solution of a surfactant (e.g., sodium alkylbenzenesulfonate) serving as a dispersant. The mixture is added to 100 to 150 mL of the electrolyte.

The sample suspended in the electrolyte is dispersed using a sonicator for 1 minute. The particle size distribution of particles having particle sizes of 2 to 60 μm is determined on a Coulter Multisizer II using an aperture with an aperture size of 100 μm. A total of 50,000 particles are sampled.

The resulting particle size distribution is divided into particle size classes (channels). Cumulative volume and number distributions are drawn from smaller particle sizes. The volume particle size D16v is defined as the particle size at which the cumulative volume is 16%. The number particle size D16p is defined as the particle size at which the cumulative number is 16%. The volume average particle size D50v is defined as the particle size at which the cumulative volume is 50%. The number average particle size D50p is defined as the particle size at which the cumulative number is 50%. The volume particle size D84v is defined as the particle size at which the cumulative volume is 84%. The number particle size D84p is defined as the particle size at which the cumulative number is 84%.

From these particle sizes, the volume average particle size distribution index (GSDv) is calculated as $(D84v/D16v)^{1/2}$, and the number average particle size distribution index (GSDp) is calculated as $(D84p/D16p)^{1/2}$.

The toner particles preferably have a shape factor SF1 of 110 to 150, more preferably 120 to 140.

The shape factor SF1 may be calculated by the following equation:

$$SF1=(ML^2/A)\times(\pi/4)\times 100$$

where ML is the absolute maximum length of the toner particles, and A is the projected area of the toner particles.

Typically, the shape factor SF1 is numerically determined by analyzing a microscope image or a scanning electron microscope (SEM) image using an image analyzer. Specifically, the shape factor SF1 may be determined as follow. A light microscope image of particles dispersed over a surface of a glass slide is captured into a Luzex image analyzer with a video recorder. The maximum lengths and projected areas of 100 particles are determined and are substituted into the above equation to calculate the shape factors SF1 of the individual particles, and the average shape factor SF1 is calculated.

External Additive

The toner according to this exemplary embodiment may contain external additives other than particles of metallic salts of fatty acids. Examples of other external additives include the following inorganic particles and resin particles.

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment may be performed, for example, by immersing the inorganic particles in a hydrophobic agent. Non-limiting examples of hydrophobic agents include silane coupling agents, silicone oil, titanate coupling agents, and aluminum coupling agents. These hydrophobic agents may be used alone or in combination.

The hydrophobic agent is typically used in an amount of, for example, 1 to 10 parts by mass per 100 parts by mass of the inorganic particles.

Other examples of external additives include resin particles (e.g., resin particles such as polystyrene, polymethyl methacrylate (PMMA), and melamine resin particles) and cleaning active agents (e.g., fluoropolymer particles).

The external additive is preferably present in an amount of, for example, 0.01% to 5% by mass, more preferably 0.01% to 2.0% by mass, of the toner particles.

Method for Manufacturing Toner

A method for manufacturing the toner according to this exemplary embodiment will now be described.

The toner according to this exemplary embodiment may be manufactured by manufacturing toner particles and adding an external additive to the toner particles.

The toner particles may be manufactured either by dry processes (e.g., pulverization) or by wet processes (e.g., aggregation coalescence, suspension polymerization, and dissolution suspension). The toner particles may be manufactured by any process, including known processes.

For example, the toner particles may be manufactured by aggregation coalescence.

Specifically, if the toner particles are manufactured by aggregation coalescence, they may be manufactured, for example, by the steps of providing a resin particle dispersion in which resin particles serving as a binder resin are dispersed (resin-particle-dispersion providing step); aggregating the resin particles (and optionally other particles) in the resin particle dispersion (optionally mixed with other particle dispersions) to form aggregated particles (aggregated-particle forming step); and heating the aggregated particle dispersion in which the aggregated particles are dispersed to coalesce the aggregated particles, thereby forming toner particles (coalescing step).

The individual steps will now be described in greater detail.

Although a method for manufacturing toner particles containing a colorant and a release agent will be described below, the colorant and the release agent are optional. It should be understood that additives other than colorants and release agents may also be used.

Resin-Particle-Dispersion Providing Step

A resin particle dispersion in which resin particles serving as a binder resin are dispersed is provided. Also provided are, for example, a colorant particle dispersion in which colorant particles are dispersed and a release agent dispersion in which release agent particles are dispersed.

The resin particle dispersion may be prepared, for example, by dispersing resin particles in a dispersion medium with a surfactant.

Examples of dispersion media for use in the resin particle dispersion include aqueous media.

Examples of aqueous media include water, such as distilled water and ion exchange water, and alcohols. These aqueous media may be used alone or in combination.

Examples of surfactants include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. For example, anionic and cationic surfactants may be used. Nonionic surfactants may be used in combination with anionic and cationic surfactants.

These surfactants may be used alone or in combination.

The resin particles may be dispersed in the dispersion medium, for example, by common dispersion processes using machines such as rotary shear homogenizers and media mills such as ball mills, sand mills, and Dyno-Mills. The resin particles may also be dispersed in the dispersion medium by phase-inversion emulsification, depending on the type of resin particles.

In phase-inversion emulsification, the resin to be dispersed is dissolved in a hydrophobic organic solvent in which the resin is soluble. After the organic continuous phase (0-phase) is neutralized with a base, an aqueous medium (W-phase) is added to cause phase inversion from water-in-oil (W/O) to oil-in-water (O/W), thereby dispersing the resin in the form of particles in the aqueous medium.

The resin particles dispersed in the resin particle dispersion preferably have a volume average particle size of, for example, 0.01 to 1 μm, more preferably 0.08 to 0.8 μm, even more preferably 0.1 to 0.6 μm.

The volume average particle size of the resin particles may be determined as follows. A particle size distribution is obtained using a laser diffraction particle size distribution analyzer (e.g., LA-700, Horiba, Ltd.) and is divided into particle size classes (channels). A cumulative volume distribution is drawn from smaller particle sizes. The volume average particle size D50v is determined as the particle size at which the cumulative volume is 50% of all particles. The volume average particle sizes of particles dispersed in other dispersions may also be determined in the same manner.

The resin particles are preferably present in the resin particle dispersion in an amount of, for example, 5% to 50% by mass, more preferably 10% to 40% by mass.

For example, the colorant dispersion and the release agent dispersion may be prepared in the same manner as the resin particle dispersion. That is, the volume average particle size, dispersion medium, dispersion process, and amount of particles of the colorant dispersion and the release agent dispersion may be similar to those of the resin particle dispersion.

Aggregated-Particle Forming Step

The resin particle dispersion, the colorant particle dispersion, and the release agent dispersion are mixed together.

The resin particles, the colorant particles, and the release agent particles are subjected to heteroaggregation in the mixed dispersion to form aggregated particles including the resin particles, the colorant particles, and the release agent particles. The aggregated particles are close in size to the target toner particles.

Specifically, the aggregated particles may be formed, for example, by adding a coagulant to the mixed dispersion, adjusting the mixed dispersion to an acidic pH (e.g., a pH of 2 to 5), optionally adding a dispersion stabilizer, and heating the mixed dispersion to aggregate the particles dispersed therein. The mixed dispersion is heated to a temperature close to the glass transition temperature of the resin particles (e.g., 10° C. to 30° C. lower than the glass transition temperature of the resin particles).

For example, the aggregated-particle forming step may be performed by adding a coagulant to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and heating the mixed dispersion.

Examples of coagulants include surfactants of opposite polarity to the surfactant present in the mixed dispersion, inorganic metal salts, and metal complexes with a valence of two or more. The use of metal complexes as the coagulant may allow for a reduction in the amount of surfactant used to improve the charging characteristics.

The coagulant may optionally be used in combination with additives that form a complex or a similar linkage with metal ions of the coagulant. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The chelating agent is preferably present in an amount of, for example, 0.01 to 5.0 parts by mass, more preferably 0.1 to less than 3.0 parts by mass, per 100 parts by mass of the resin particles.

Coalescing Step

The aggregated particle dispersion in which the aggregated particles are dispersed is heated, for example, at or above the glass transition temperature of the resin particles (e.g., 10° C. to 30° C. higher than the glass transition temperature of the resin particles) to coalesce the aggregated particles, thereby forming toner particles.

After the above steps, toner particles are obtained.

The toner particles may also be manufactured by the steps of, after obtaining the aggregated particle dispersion in which the aggregated particles are dispersed, mixing the aggregated particle dispersion and the resin particle dispersion in which the resin particles are dispersed, aggregating the resin particles on the surfaces of the aggregated particles to form second aggregated particles, and heating the second aggregated particle dispersion in which the second aggregated particles are dispersed to coalesce the second aggregated particles, thereby forming core-shell toner particles.

Upon completion of the coalescing step, the toner particles formed in the dispersion are subjected to known washing, solid-liquid separating, and drying steps to obtain dry toner particles.

In the washing step, the toner particles may be sufficiently washed by displacement washing with ion exchange water for reasons of charging characteristics. Although the solid-liquid separating step may be performed by any process, processes such as suction filtration and pressure filtration may be used for reasons of productivity. Although the drying step may be performed by any process, processes such as freeze drying, flush jet drying, fluidized bed drying, and vibrating fluidized bed drying may be used for reasons of productivity.

The toner according to this exemplary embodiment may be manufactured, for example, by mixing the resulting dry toner particles with an external additive. The mixing may be performed, for example, using machines such as V-blenders, Henschel mixers, and Loedige mixers. Optionally, coarse toner particles may be removed using machines such as vibrating screens and air screens.

Electrostatic Image Developer

An electrostatic image developer according to an exemplary embodiment of the present invention contains at least the toner according to the above exemplary embodiment. The electrostatic image developer according to this exemplary embodiment may be a one-component developer containing only the toner according to the above exemplary embodiment or a two-component developer containing the toner and a carrier.

The carrier may be any carrier, including known carriers. Examples of carriers include coated carriers made of a magnetic powder used as cores and coated with a resin, magnetic-powder-dispersed carriers made of a matrix resin in which a magnetic powder is dispersed, and resin-impregnated carriers made of a porous magnetic powder impregnated with a resin. The constituent particles of the magnetic-powder-dispersed carriers and the resin-impregnated carriers may be used as cores and coated with a resin.

Examples of magnetic powders include magnetic metal powders such as iron, nickel, and cobalt powders and magnetic oxide powders such as ferrite and magnetite powders.

Examples of resins for coating and matrix resins include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylic acid copolymers, straight silicone resins containing organosiloxane bonds and modified products thereof, fluoropolymers, polyesters, polycarbonates, phenolic resins, and epoxy resins. The resin for coating and the matrix resin may contain additives such as conductive particles. Examples of conductive particles include metal particles such as gold, silver, and copper particles and other particles such as carbon black, titanium oxide, zinc oxide, tin oxide, barium sulfate, aluminum borate, and potassium titanate particles.

The cores may be coated with the resin, for example, by dissolving the resin for coating and various additives (optional) in a suitable solvent and coating the cores with the resulting coating solution. The solvent may be any solvent selected depending on, for example, the type of resin used and the suitability for coating. Examples of resin coating processes include dipping, in which the cores are dipped in the coating solution, spraying, in which the cores are sprayed with the coating solution, fluidized bed coating, in which the cores are sprayed with the coating solution while being suspended in air stream, and kneader coating, in which the carrier cores and the coating solution are mixed in a kneader coater and the solvent is then removed.

The mixing ratio (by mass) of the toner to the carrier in the two-component developer is preferably 1:100 to 30:100, more preferably 3:100 to 20:100.

Image-Forming Apparatus and Method

An image-forming apparatus and method according to an exemplary embodiment of the present invention will now be described.

The image-forming apparatus according to this exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, a transfer unit that transfers the toner image from the surface of the image carrier to a surface of a recording medium, a fixing unit that fixes the toner image to the surface of the recording medium, and a cleaning unit that includes a blade disposed in contact with the surface of the image carrier and that removes residual toner from the surface of the image carrier with the blade after the transfer of the toner image. The electrostatic image developer is the electrostatic image developer according to the above exemplary embodiment.

The image-forming apparatus according to this exemplary embodiment executes an image-forming method (the image-forming method according to this exemplary embodiment) including a charging step of charging the surface of the image carrier, an electrostatic-image forming step of forming an electrostatic image on the charged surface of the image carrier, a developing step of developing the electrostatic image formed on the surface of the image carrier with the electrostatic image developer according to the above exemplary embodiment to form a toner image, a transfer step of transferring the toner image from the surface of the image carrier to a surface of a recording medium, a fixing step of fixing the toner image to the surface of the recording medium, and a cleaning step of removing residual toner from the surface of the image carrier with the blade disposed in contact with the surface of the image carrier after the transfer of the toner image.

The image-forming apparatus according to this exemplary embodiment may be a known type of image-forming apparatus. For example, the image-forming apparatus according to this exemplary embodiment may be a direct-transfer image-forming apparatus that transfers a toner image from a surface of an image carrier directly to a recording medium; an intermediate-transfer image-forming apparatus that transfers a toner image from a surface of an image carrier to a surface of an intermediate transfer member and then transfers the toner image from the surface of the intermediate transfer member to a surface of a recording medium; or an image-forming apparatus including an erase unit that erases charge on a surface of an image carrier by irradiation with erase light after the transfer of the toner image and before charging.

If the image-forming apparatus according to this exemplary embodiment is an intermediate-transfer image-forming apparatus, the transfer unit includes, for example, an intermediate transfer member having a surface to which a toner image is transferred, a first transfer unit that transfers the toner image from the surface of the image carrier to the surface of the intermediate transfer member, and a second transfer unit that transfers the toner image from the surface of the intermediate transfer member to a surface of a recording medium.

The image-forming apparatus according to this exemplary embodiment may include, for example, a cartridge structure (process cartridge) including a developing unit and attachable to and detachable from the image-forming apparatus. The process cartridge may include, for example, a developing unit containing the electrostatic image developer according to the above exemplary embodiment.

A non-limiting example of the image-forming apparatus according to this exemplary embodiment will now be described. In the following description, the parts shown in the drawings are described, and other parts are not described.

FIG. 1 is a schematic view of the image-forming apparatus according to this exemplary embodiment.

An image-forming apparatus 300 shown in FIG. 1 includes, for example, a rectangular housing 200 and a sheet tray 204 disposed in the lower part of the housing 200 and containing sheets of recording paper (an example of a recording medium) P. A pickup roller 92 is disposed at one end of an arm that picks a sheet of recording paper P from the sheet tray 204. A roller 94 is disposed at the other end of the arm. A roller 96 is disposed opposite the roller 94.

During image formation, the pickup roller 92 is moved downward depending on the level of the sheets of recording paper P contained in the sheet tray 204. The pickup roller 92 is rotated in contact with the topmost sheet of recording paper P to pick the sheet of recording paper P. The picked sheet of recording paper P is transported to the rollers 94 and 96 and is held and transported between a pair of rollers 82 disposed downstream of the roller 96 in the sheet transport direction. Opposing rollers 84 and 86, a roller 88 that changes the sheet transport direction, and a pair of rollers 90 are arranged downstream of the pair of rollers 82 in the above order in the sheet transport direction.

The image-forming apparatus 300 also includes a cylindrical photoreceptor (an example of an image carrier) 10 that rotates clockwise in the upper part of the housing 200.

A charging roller (an example of a charging unit) 20, an exposure device (an example of an electrostatic-image forming unit) 30, a developing device (an example of a developing unit) 40, a transfer roller (an example of a transfer unit) 52, an erase device (an example of an erase unit) 60, and a cleaning device (an example of a cleaning unit) 70 are arranged clockwise in the above order around the photoreceptor 10. The charging roller 20 is disposed opposite the photoreceptor 10 and charges the surface of the photoreceptor 10 to a predetermined potential. The exposure device 30 exposes the surface of the photoreceptor 10 charged by the charging roller 20 to form an electrostatic image. The developing device 40 supplies a charged toner to the electrostatic image to develop the electrostatic image. The transfer roller 52 is disposed opposite the photoreceptor 10 and transfers the toner image to a sheet of recording paper P. The erase device 60 is disposed opposite the photoreceptor 10 and erases charge on the surface of the photoreceptor 10 by irradiation with erase light after the transfer of the toner image to the sheet of recording paper P. The cleaning device 70 cleans the surface of the photoreceptor 10 to remove residual toner. A supply transport path (an example of a toner supply unit) 74 supplies the removed toner (reclaimed toner) to the developing device 40. The erase device 60 is optional.

The charging roller 20 negatively charges the surface of the photoreceptor 10. The exposure device 30 then forms an electrostatic image on the charged surface of the photoreceptor 10.

The developing device 40 will now be described. The developing device 40 is disposed opposite the photoreceptor 10 in a developing area. The developing device 40 includes, for example, a developing container 41 containing a two-component developer containing a negatively (−) chargeable toner and a positively (+) chargeable carrier. The developing container 41 includes a developing container body 41A and a developing container covering 41B covering the top end thereof.

The interior of the developing container body 41A includes a developing roller chamber 42A accommodating a developing roller 42, a first stirring chamber 43A adjacent to the developing roller chamber 42A, and a second stirring chamber 44A adjacent to the first stirring chamber 43A. The developing roller chamber 42A also accommodates a layer-thickness regulating member 45 that regulates the thickness of the layer of developer on the surface of the developing roller 42 when the developing container covering 41B is attached to the developing container body 41A.

The first stirring chamber 43A and the second stirring chamber 44A are separated by a partition 41C and communicate via openings (not shown) provided at both ends of the partition 41C in the longitudinal direction (in the longitudinal direction of the developing device 40). The first stirring chamber 43A and the second stirring chamber 44A form a circulation stirring chamber (43A+44A).

The developing roller 42 is disposed in the developing roller chamber 42A opposite the photoreceptor 10. The developing roller 42 and the photoreceptor 10 rotate in opposite directions. The developing roller 42 includes a magnetic roller (fixed magnet) and a sleeve disposed around the magnetic roller. The developer present in the first stirring chamber 43A is attracted to the surface of the developing roller 42 by the magnetic force of the magnetic roller. The shaft of the developing roller 42 is rotatably supported by the developing container body 41A.

A bias power supply (not shown) is connected to the sleeve of the developing roller 42. The bias power supply applies, for example, a developing bias including a direct-current (DC) component and an alternating-current (AC) component superimposed thereon.

A first stirring member 43 (stirring transport member) that transports the developer with stirring is disposed in the first stirring chamber 43A. A second stirring member 44 (stirring transport member) that transports the developer with stirring is disposed in the second stirring chamber 44A. The first stirring member 43 includes a first rotating shaft extending along the axis of the developing roller 42 and a stirring transport impeller (protrusion) fixed spirally around the rotating shaft. Similarly, the second stirring member 44 includes a second rotating shaft and a stirring transport impeller (protrusion). The stirring members 43 and 44 are rotatably supported by the developing container body 41A. As the first and second stirring members 43 and 44 rotate, the developer in the first stirring chamber 43A and the developer in the second stirring chamber 44A are transported in opposite directions.

The cleaning device 70 will now be described. The cleaning device 70 includes a housing 71 and a cleaning blade 72 extending from the housing 71. The cleaning blade 72 is plate-shaped and has its leading edge (hereinafter also referred to as "edge") in contact with the photoreceptor 10. The cleaning blade 72 is disposed downstream of the position where the transfer roller 52 transfers a toner image from the photoreceptor 10 in the rotational direction (clockwise) and downstream of the position where the erase device 60 erases charge on the photoreceptor 10 in the rotational direction.

As the photoreceptor 10 rotates clockwise, the cleaning blade 72 collects foreign substances such as toner remaining on the surface of the photoreceptor 10 without being transferred to sheets of recording paper P and paper dust produced from sheets of recording paper P and removes them from the photoreceptor 10.

The cleaning blade 72 may be made of a known material such as urethane rubber, silicone rubber, fluoroelastomer, chloroprene rubber, or butadiene rubber. For example, polyurethane may be used because of its good wear resistance.

A transport member 73 is disposed at the bottom of the housing 71. One end of the supply transport path 74 is connected to the housing 71 downstream of the transport member 73 in the transport direction to supply the toner (developer) removed by the cleaning blade 72 to the developing device 40. The other end of the supply transport path 74 is connected to the developing device 40 (second stirring chamber 44A).

As the transport member 73 disposed at the bottom of the housing 71 rotates, the toner removed by the cleaning blade 72 is supplied from the cleaning device 70 through the supply transport path 74 to the developing device 40 (second stirring chamber 44A). The reclaimed toner supplied to the second stirring chamber 44A is stirred together with the toner contained in the second stirring chamber 44A and is reused. The image-forming apparatus 300 has a toner reclaim system for the reuse of reclaimed toner. The developing device 40 is also supplied with toner from a toner cartridge 46 through a toner supply tube (not shown).

A sheet of recording paper P transported to the position where the transfer roller 52 is disposed opposite the photoreceptor 10 is pressed against the photoreceptor 10 by the transfer roller 52 to transfer a toner image from the outer surface of the photoreceptor 10 to the sheet of recording paper P. A fixing device (an example of a fixing unit) including a fixing roller 100 and a roller 102 disposed opposite the fixing roller 100 and a cam 104 are arranged in the above order downstream of the transfer roller 52 in the sheet transport direction. The sheet of recording paper P having the toner image thereon is held between the fixing roller 100 and the roller 102 to fix the toner image and is transported to the position where the cam 104 is disposed. The cam 104 is rotated by a motor (not shown) and is fixed at the position indicated by the solid line or the phantom line in FIG. 1.

When the sheet of recording paper P is transported from the fixing roller 100 to the cam 104, the cam 104 is rotated away from the fixing roller 100 (to the position indicated by the solid line). The sheet of recording paper P transported from the fixing roller 100 is guided along the outer surface of the cam 104 to a pair of rollers 106. The pairs of rollers 106 and other pairs of rollers 108, 112, and 114 are arranged in the above order downstream of the cam 104 in the sheet guide direction. A sheet bin 202 is disposed downstream of the pair of rollers 114 in the sheet transport direction.

The sheet of recording paper P transported from the fixing roller 100 is held between the pairs of rollers 106 and 108 and is transported to the sheet bin 202 as the pairs of rollers 106 and 108 rotate continuously.

To invert the sheet of recording paper P held between the pairs of rollers 106 and 108 after image formation on one side thereof, the cam 104 is rotated toward the fixing roller 100 (to the position indicated by the phantom line). In this state, the pairs of rollers 106 and 108 are rotated in the reverse direction, and accordingly, the sheet of recording paper P is transported in the reverse direction (hereinafter referred to as "switched back"). As the sheet of recording paper P is transported from the pairs of rollers 106 and 108 toward the cam 104, the sheet of recording paper P is guided downward along the outer surface of the cam 104. A pair of rollers 120 are disposed downstream of the cam 104 in the sheet transport direction. The sheet of recording paper P is transported to the position where the pair of rollers 120 are disposed and is further transported by the transport force of the pair of rollers 120.

In FIG. 1, the transport path of the sheet of recording paper P is indicated by the phantom line.

Pairs of rollers 122, 124, 126, 128, 130, and 132 are arranged in the above order downstream of the pair of rollers 120 along the transport path of the sheet of recording paper P indicated by the phantom line in FIG. 1. The cam 104 and the pairs of rollers 106, 108, 120, 122, 124, 126, 128, 130, and 132 form a sheet-inverting unit 220. The sheet of recording paper P switched back at the position where the pairs of rollers 106 and 108 are disposed is transported along the transport path indicated by the phantom line in FIG. 1 to the position where the pair of rollers 90 are disposed and is transported back to the nip between the photoreceptor 10 and the transfer roller 52.

Since the sheet of recording paper P has been switched back by the sheet-inverting unit 220, as described above, the back side, which is opposite the side on which an image has been formed first, faces the photoreceptor 10. After a toner image is transferred to the back side and is fixed by the fixing roller 100, the sheet of recording paper P has images on both sides. The sheet of recording paper P having images on both sides is output to the sheet bin 202 such that the side on which an image has been formed later faces downward. If no image is formed on the sheet of recording paper P in the later image-forming process (i.e., in the image-forming process after the inversion of the sheet of recording paper P by the sheet-inverting unit 220), the sheet of recording paper P is output to the sheet bin 202 such that the side on which an image has been formed first faces upward.

Examples of recording paper P to which toner images are transferred include plain paper for use in devices such as electrophotographic copiers and printers. Examples of recording media other than recording paper include OHP sheets. The recording paper P may also be, for example, coated paper, which is plain paper coated with a material such as resin, or art paper for printing.

Process Cartridge and Toner Cartridge

A process cartridge according to an exemplary embodiment of the present invention will now be described.

The process cartridge according to this exemplary embodiment is attachable to and detachable from an image-forming apparatus. The process cartridge according to this exemplary embodiment includes an image carrier, a developing unit that contains the electrostatic image developer according to the above exemplary embodiment and that develops an electrostatic image formed on the surface of the image carrier with the electrostatic image developer to form a toner image, and a cleaning unit that includes a blade disposed in contact with the surface of the image carrier and that removes residual toner from the surface of the image carrier with the blade after the transfer of the toner image.

The process cartridge according to this exemplary embodiment may have other configurations. For example, the process cartridge according to this exemplary embodiment may include the developing unit and optionally at least one other unit selected from a charging unit, an electrostatic-image forming unit, and a transfer unit.

A non-limiting example of the process cartridge according to this exemplary embodiment will now be described. In the following description, the parts shown in the drawings are described, and other parts are not described.

Figure 2:
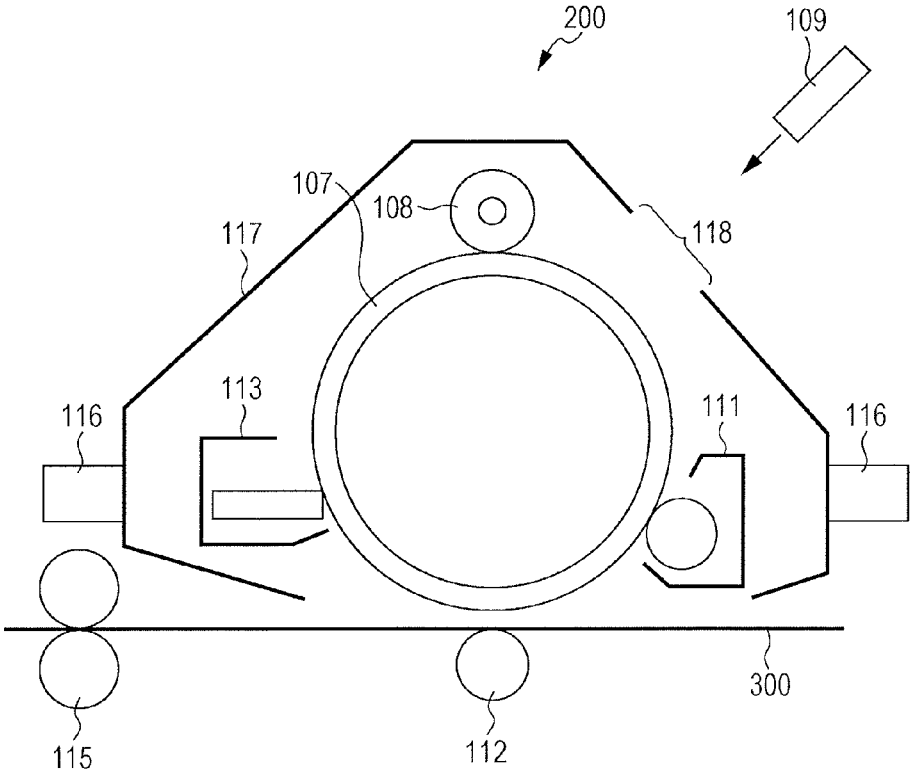
FIG. 2 is a schematic view of an example of a process cartridge according to an exemplary embodiment of the present invention.

FIG. 2 is a schematic view of the process cartridge according to this exemplary embodiment.

A process cartridge 200 shown in FIG. 2 includes, for example, a photoreceptor (an example of an image carrier) 107 around which are arranged a charging roller (an example of a charging unit) 108, a developing device (an example of a developing unit) 111, and a photoreceptor-cleaning device (an example of a cleaning unit) 113. The photoreceptor 107, the charging roller 108, the developing device 111, and the photoreceptor-cleaning device 113 are assembled into a cartridge with a housing 117 having mounting rails 116 and an opening 118 for exposure. The photoreceptor-cleaning device 113 includes a blade disposed in contact with the photoreceptor 107.

FIG. 2 also shows an exposure device (an example of an electrostatic-image forming unit) 109, a transfer device (an example of a transfer unit) 112, a fixing device (an example of a fixing unit) 115, and a sheet of recording paper (an example of a recording medium) 300.

A toner cartridge according to an exemplary embodiment of the present invention will now be described.

The toner cartridge according to this exemplary embodiment is attachable to and detachable from an image-forming apparatus and contains the toner according to the above exemplary embodiment. The toner cartridge contains refill toner to be supplied to a developing unit provided in an image-forming apparatus.

As shown in FIG. 1, the toner cartridge 46 is attachable to and detachable from the image-forming apparatus 300. The developing device 40 is connected to the toner cartridge 46 through the toner supply tube (not shown). The toner cartridge 46 is replaced when the toner level thereof is low.

EXAMPLES

Exemplary embodiments of the present invention are further illustrated by the following non-limiting examples. In the following description, parts and percentages are by mass unless otherwise specified.

Preparation of Particles of Metallic Salt of Fatty Acid 1A

In a heatable stainless steel reaction vessel 1 equipped with a stirrer and a temperature sensor is placed 4 parts of ion exchange water, and the water is heated to 70° C. with stirring. In a heatable stainless steel reaction vessel 2 equipped with a stirrer and a temperature sensor is placed 1.4 parts of a beef tallow fatty acid, and the beef tallow fatty acid is melted. To the stainless steel reaction vessel 1 is added the molten beef tallow fatty acid, and the mixture is heated again to 70° C. with stirring. To the mixture is added dropwise a solution of 2 parts of sodium hydroxide in 100 parts of ion exchange water, and the fatty acid is dispersed to obtain an emulsion. In 3,000 parts of ion exchange water are dispersed and dissolved 100 parts of zinc hydroxide and 100 parts of zinc sulfate, and the mixture is added dropwise to the fatty acid emulsion, which is maintained at 70° C. After the addition is complete, the mixture is heated to 80° C. and is reacted for 60 minutes. The reaction product is washed with water, filtered, dehydrated, and dried to obtain solid zinc stearate. The solid is pulverized in a ball mill to obtain Particles of Metallic Salt of Fatty Acid 1A (zinc stearate), which have a volume average particle size of 3 μm.

Preparation of Particles of Metallic Salt of Fatty Acid 1B

Particles of Metallic Salt of Fatty Acid 1B (zinc stearate) are prepared in the same manner as Particles of Metallic Salt of Fatty Acid 1A except that the amount of zinc hydroxide is changed to 150 parts and the amount of zinc sulfate is changed to 50 parts. Particles of Metallic Salt of Fatty Acid 1B have a volume average particle size of 3 μm.

Preparation of Particles of Metallic Salt of Fatty Acid 1C

Particles of Metallic Salt of Fatty Acid 1C (zinc stearate) are prepared in the same manner as Particles of Metallic Salt of Fatty Acid 1A except that the amount of zinc hydroxide is changed to 180 parts and the amount of zinc sulfate is changed to 20 parts. Particles of Metallic Salt of Fatty Acid 1C have a volume average particle size of 3 μm.

Preparation of Particles of Metallic Salt of Fatty Acid 1D

Particles of Metallic Salt of Fatty Acid 1D (zinc stearate) are prepared in the same manner as Particles of Metallic Salt of Fatty Acid 1A except that the amount of zinc hydroxide is changed to 200 parts and the amount of zinc sulfate is changed to 0 part. Particles of Metallic Salt of Fatty Acid 1D have a volume average particle size of 3 μm.

Preparation of Particles of Metallic Salt of Fatty Acid 1E

Particles of Metallic Salt of Fatty Acid 1E (zinc stearate) are prepared in the same manner as Particles of Metallic Salt of Fatty Acid 1A except that the amount of zinc hydroxide is changed to 197 parts and the amount of zinc sulfate is changed to 3 parts. Particles of Metallic Salt of Fatty Acid 1E have a volume average particle size of 3 μm.

Preparation of Particles of Metallic Salt of Fatty Acid 1F

Particles of Metallic Salt of Fatty Acid 1F (zinc stearate) are prepared in the same manner as Particles of Metallic Salt of Fatty Acid 1A except that the amount of zinc hydroxide is changed to 0 part and the amount of zinc sulfate is changed to 200 parts. Particles of Metallic Salt of Fatty Acid 1F have a volume average particle size of 3 μm.

Preparation of Particles of Metallic Salt of Fatty Acid 2

Particles of Metallic Salt of Fatty Acid 2 (zinc laurate) are prepared in the same manner as Particles of Metallic Salt of Fatty Acid 1A except that the beef tallow fatty acid is replaced with lauric acid. Particles of Metallic Salt of Fatty Acid 2 have a volume average particle size of 3 μm.

Preparation of Particles of Metallic Salt of Fatty Acid 3

Particles of Metallic Salt of Fatty Acid 3 (calcium stearate) are prepared in the same manner as Particles of Metallic Salt of Fatty Acid 1A except that zinc hydroxide and zinc sulfate are replaced with calcium hydroxide and calcium sulfate. Particles of Metallic Salt of Fatty Acid 3 have a volume average particle size of 3 μm.

Preparation of Particles of Metallic Salt of Fatty Acid 4

Particles of Metallic Salt of Fatty Acid 4 (potassium laurate) are prepared in the same manner as Particles of Metallic Salt of Fatty Acid 1A except that the beef tallow fatty acid is replaced with lauric acid and zinc hydroxide and zinc sulfate are replaced with potassium hydroxide and potassium sulfate. Particles of Metallic Salt of Fatty Acid 4 have a volume average particle size of 3 μm.

Preparation of Particles of Metallic Salt of Fatty Acid 5

Particles of Metallic Salt of Fatty Acid 5 (iron(II) stearate) are prepared in the same manner as Particles of Metallic Salt of Fatty Acid 1A except that zinc hydroxide and zinc sulfate are replaced with iron(II) hydroxide and iron(II) sulfate. Particles of Metallic Salt of Fatty Acid 5 have a volume average particle size of 3 μm.

Preparation of Resin Particle Dispersion

Terephthalic acid: 30 molar parts
Fumaric acid: 70 molar parts
Bisphenol A-ethylene oxide adduct: 5 molar parts
Bisphenol A-propylene oxide adduct: 95 molar parts The above ingredients are placed in a 5 L flask equipped with a stirrer, a nitrogen inlet tube, a temperature sensor, and a fractionating column, and the mixture is heated to 220° C. in 1 hour. To the mixture is added titanium tetraethoxide in an amount of 1 part per 100 parts of the above ingredients. The mixture is heated to 230° C. in 0.5 hour and is maintained at the same temperature to continue a dehydration condensation reaction for 1 hour while removing the resulting water. The reaction product is cooled to obtain a polyester resin having a weight average molecular weight of 18,000, an acid value of 15 mg KOH/g, and a glass transition temperature of 60° C.

In a vessel equipped with a temperature control unit and a nitrogen purging unit are placed 40 parts of ethyl acetate and 25 parts of 2-butanol. To the solvent mixture is gradually added and dissolved 100 parts of the polyester resin. To the solution is added 10% aqueous ammonia (in a molar ratio equivalent to three times the acid value of the resin), and the mixture is stirred for 30 minutes.

The vessel is purged with dry nitrogen and is maintained at 40° C. To the mixture, 400 parts of ion exchange water is added dropwise at a rate of 2 parts per minute with stirring to perform emulsification. After the addition is complete, the emulsion is returned to room temperature (20° C. to 25° C.) and is bubbled with dry nitrogen with stirring for 48 hours to remove ethyl acetate and 2-butanol to 1,000 ppm or less. The resulting dispersion contains resin particles having a volume average particle size of 200 nm. Ion exchange water is then added to a solid content of 20% to obtain a resin particle dispersion.

Preparation of Colorant Dispersion

C.I. Pigment Yellow 74 (Clariant): 70 parts
Anionic surfactant (Neogen RK, DKS Co. Ltd.): 1 part
Ion exchange water: 200 parts The above ingredients are mixed together. The mixture is dispersed using a homogenizer (Ultra-Turrax T50, IKA) for 10 minutes. Ion exchange water is then added to a solid content of 20% to obtain a colorant dispersion containing colorant particles having a volume average particle size of 190 nm.

Preparation of Release Agent Dispersion

Paraffin wax (HNP-9, Nippon Seiro Co., Ltd.): 100 parts
Anionic surfactant (Neogen RK, DKS Co. Ltd.): 1 part
Ion exchange water: 350 parts The above ingredients are mixed together. The mixture is heated to 100° C. and is dispersed using a homogenizer (Ultra-Turrax T50, IKA). The mixture is further dispersed using a Manton-Gaulin high-pressure homogenizer (Gaulin)

to obtain a release agent dispersion containing release agent particles having a volume average particle size of 200 nm (solid content=20%).

Preparation of Toner Particles

Resin Particle Dispersion: 425 parts

Colorant dispersion: 25 parts

Release agent dispersion: 50 parts

Anionic surfactant (Taycapower, Tayca Corporation): 2 parts

The above ingredients are placed in a round-bottom stainless steel flask. After the mixture is adjusted to a pH of 3.5 by adding 0.1 N nitric acid, 30 parts of a 10% by mass solution of polyaluminum chloride in aqueous nitric acid is added. The mixture is dispersed at 30° C. using a homogenizer (Ultra-Turrax T50, IKA) and is then heated to and maintained at 45° C. in a heating oil bath for 30 minutes. To the mixture is gently added 100 parts of the resin particle dispersion, and the mixture is maintained at the same temperature for 1 hour. After the mixture is adjusted to a pH of 8.5 by adding 0.1 N aqueous sodium hydroxide solution, the mixture is heated to and maintained at 85° C. with continued stirring for 5 hours. The mixture is cooled to 20° C. at 20° C./min, is filtered, is sufficiently washed with ion exchange water, and is dried to obtain toner particles having a volume average particle size of 6 μm.

Preparation of Carrier

Ferrite particles (average particle size=35 μm): 100 parts

Toluene: 14 parts

Styrene-methyl methacrylate copolymer (copolymerization ratio=15/85): 2 parts

Carbon black: 0.2 part

The above ingredients except the ferrite particles are dispersed in a sand mill to prepare a dispersion. The dispersion and the ferrite particles are placed in a vacuum degassing kneader. The mixture is dried under reduced pressure with stirring to obtain a carrier.

Example 1

Preparation of External-Additive Containing Toner

In a Henschel mixer are placed 100 parts of the toner particles, 2.5 parts of hydrophobic silica particles (RY50, Nippon Aerosil Co., Ltd.), and 0.1 part of Particles of Metallic Salt of Fatty Acid 1A, and the mixture is stirred at a peripheral speed of 30 m/s for 3 minutes. The mixture is then passed through a 45 μm mesh vibrating sieve to obtain an external-additive containing toner.

Preparation of Developer

In a 2 L V-blender are placed 10 parts of the external-additive containing toner and 100 parts of the carrier, and the mixture is stirred for 20 minutes. The mixture is then passed through a 212 μm mesh sieve to obtain a developer.

Elemental Analysis of Particles of Metallic Salt of Fatty Acid

The developer is separated into the toner and the carrier through a jet sieve. The separated toner is suspended in water. The suspension is sonicated and filtered through filter paper (particle size retention=5 μm). The particles of the metallic salt of the fatty acid, which are an external additive with low specific gravity, are separated from the filtrate by centrifugation and are dried. The dry particles of the metallic salt of the fatty acid are tested for sulfur element content by elemental analysis using an X-ray fluorescence spectrometer (XRF-1500, Shimadzu Corporation).

Cleaning Blade Wear Evaluation

A modified Fuji-Xerox ApeosPort-IV C5570 is provided, and the developer is supplied to its developing device (the toner is negatively chargeable). This image-forming apparatus is used to produce 4,000 images with an area coverage of 5% in a high-temperature, high-humidity environment (28° C., 85% RH) and then 20,000 images in a low-temperature, low-humidity environment (10° C., 15% RH).

In this image-forming operation, the image region is located in the center of the photoreceptor in the axial direction, and the non-image regions are located 10 cm from the center of the photoreceptor in the axial direction.

The cross-sectional profile of the photoreceptor cleaning blade is examined under a laser microscope (VK-9500, Keyence Corporation) before and after the image-forming operation. The cross-sectional profile is examined in two regions with a length of 80 μm in the axial direction, one located in the center of the photoreceptor in the axial direction and the other located 10 cm from the center of the photoreceptor in the axial direction. For each of the two regions, the difference between the cross-sectional areas before and after the image-forming operation is calculated to obtain the cross-sectional wear area ($\mu m^2$). The difference between the cross-sectional wear areas of the two regions is calculated to obtain the axial variation ($\mu m^2$).

The axial direction of the cleaning blade is the same as the axial direction of the photoreceptor.

A cleaning blade having a cross-sectional wear area of 30 $\mu m^2$ or less in both the image region and the non-image regions and an axial variation of 20 $\mu m^2$ or less is evaluated as good. Smaller cross-sectional wear areas and smaller axial variations are desirable.

Example 2

A toner and a developer are prepared as in Example 1 except that Particles of Metallic Salt of Fatty Acid 1A are replaced with Particles of Metallic Salt of Fatty Acid 1B (zinc stearate), and the image-forming operation is performed.

Example 3

A toner and a developer are prepared as in Example 1 except that Particles of Metallic Salt of Fatty Acid 1A are replaced with Particles of Metallic Salt of Fatty Acid 1C (zinc stearate), and the image-forming operation is performed.

Example 4

A toner and a developer are prepared as in Example 1 except that Particles of Metallic Salt of Fatty Acid 1A are replaced with Particles of Metallic Salt of Fatty Acid 2 (zinc laurate), and the image-forming operation is performed.

Example 5

A toner and a developer are prepared as in Example 1 except that Particles of Metallic Salt of Fatty Acid 1A are replaced with Particles of Metallic Salt of Fatty Acid 3 (calcium stearate), and the image-forming operation is performed.

Example 6

A toner and a developer are prepared as in Example 1 except that Particles of Metallic Salt of Fatty Acid 1A are replaced with Particles of Metallic Salt of Fatty Acid 4 (potassium laurate), and the image-forming operation is performed.

Example 7

A toner and a developer are prepared as in Example 1 except that Particles of Metallic Salt of Fatty Acid 1A are replaced with Particles of Metallic Salt of Fatty Acid 5 (iron(II) stearate), and the image-forming operation is performed.

Comparative Example 1

A toner and a developer are prepared as in Example 1 except that Particles of Metallic Salt of Fatty Acid 1A are replaced with Particles of Metallic Salt of Fatty Acid 1D (zinc stearate), and the image-forming operation is performed.

Comparative Example 2

A toner and a developer are prepared as in Example 1 except that Particles of Metallic Salt of Fatty Acid 1A are replaced with Particles of Metallic Salt of Fatty Acid 1E (zinc stearate), and the image-forming operation is performed.

Comparative Example 3

A toner and a developer are prepared as in Example 1 except that Particles of Metallic Salt of Fatty Acid 1A are replaced with Particles of Metallic Salt of Fatty Acid 1F (zinc stearate), and the image-forming operation is performed.

Comparative Example 4

A toner and a developer are prepared as in Example 1 except that Particles of Metallic Salt of Fatty Acid 1A are replaced with 0.1 part of elemental sulfur particles (volume average particle size=3 μm), and the image-forming operation is performed.

Comparative Example 5

A toner and a developer are prepared as in Example 1 except that Particles of Metallic Salt of Fatty Acid 1A are not used, and the image-forming operation is performed.

The compositions and evaluation results of the Examples and the Comparative Examples are summarized in Table 1.

TABLE 1

| | Particles of metallic salt of fatty acid | | Wear of cleaning blade | | |
|---|---|---|---|---|---|
| | Type of metallic salt of fatty acid | Sulfur element content | Cross-sectional wear area of image region | Cross-sectional wear area of non-image region | Axial variation |
| Example 1 | Zinc stearate | 0.05% by mass | 20 $\mu m^2$ | 10 $\mu m^2$ | 10 $\mu m^2$ |
| Example 2 | Zinc stearate | 0.03% by mass | 16 $\mu m^2$ | 15 $\mu m^2$ | 1 $\mu m^2$ |
| Example 3 | Zinc stearate | 0.005% by mass | 18 $\mu m^2$ | 9 $\mu m^2$ | 9 $\mu m^2$ |
| Example 4 | Zinc laurate | 0.05% by mass | 25 $\mu m^2$ | 12 $\mu m^2$ | 13 $\mu m^2$ |
| Example 5 | Calcium stearate | 0.05% by mass | 28 $\mu m^2$ | 13 $\mu m^2$ | 15 $\mu m^2$ |
| Example 6 | Potassium laurate | 0.05% by mass | 29 $\mu m^2$ | 11 $\mu m^2$ | 18 $\mu m^2$ |
| Example 7 | Iron(II) stearate | 0.05% by mass | 29 $\mu m^2$ | 10 $\mu m^2$ | 19 $\mu m^2$ |
| Comparative Example 1 | Zinc stearate | Not detected | 50 $\mu m^2$ | 13 $\mu m^2$ | 37 $\mu m^2$ |
| Comparative Example 2 | Zinc stearate | 0.003% by mass | 46 $\mu m^2$ | 10 $\mu m^2$ | 36 $\mu m^2$ |
| Comparative Example 3 | Zinc stearate | 0.08% by mass | 37 $\mu m^2$ | 35 $\mu m^2$ | 2 $\mu m^2$ |
| Comparative Example 4 | None | — (elemental sulfur added) | 105 $\mu m^2$ | 92 $\mu m^2$ | 13 $\mu m^2$ |
| Comparative Example 5 | None | — | 98 $\mu m^2$ | 100 $\mu m^2$ | 2 $\mu m^2$ |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

toner particles; and particles of a metallic salt of a fatty acid deposited on the toner particles, the particles of the metallic salt of the fatty acid containing 0.0035% to 0.07% by mass of sulfur element.

2. The electrostatic-image developing toner according to claim 1, wherein the particles of the metallic salt of the fatty acid comprise at least one metallic salt of a fatty acid selected from the group consisting of zinc salts of fatty acids and calcium salts of fatty acids.

3. The electrostatic-image developing toner according to claim 1, wherein the particles of the metallic salt of the fatty acid comprise at least one metallic salt of a fatty acid selected from the group consisting of metal stearates and metal laurates.

4. The electrostatic-image developing toner according to claim 1, wherein the particles of the metallic salt of the fatty acid comprise zinc stearate.

5. The electrostatic-image developing toner according to claim 1, wherein the particles of the metallic salt of the fatty acid have a volume average particle size of 0.1 to 10 μm.

6. The electrostatic-image developing toner according to claim 1, wherein the particles of the metallic salt of the fatty acid are present in an amount of 0.02 to 1 part by mass per 100 parts by mass of the toner particles.

7. The electrostatic-image developing toner according to claim 1, wherein the toner particles comprise a binder resin in an amount of 40% to 95% of the total mass of the toner particles.

8. The electrostatic-image developing toner according to claim 1, wherein the toner particles comprise a polyester resin.

9. The electrostatic-image developing toner according to claim 8, wherein the polyester resin has a glass transition temperature (Tg) of 50° C. to 80° C.

10. The electrostatic-image developing toner according to claim 8, wherein the polyester resin has a weight average molecular weight (Mw) of 5,000 to 1,000,000.

11. The electrostatic-image developing toner according to claim 8, wherein the polyester resin has a molecular weight distribution Mw/Mn of 1.5 to 100.

12. The electrostatic-image developing toner according to claim 1, wherein the toner particles contain 1% to 30% by mass of a colorant.

13. The electrostatic-image developing toner according to claim 1, wherein the toner particles contain 1% to 20% by mass of a release agent.

14. The electrostatic-image developing toner according to claim 13, wherein the release agent has a melting temperature of 50° C. to 110° C.

15. The electrostatic-image developing toner according to claim 1, wherein the toner particles have a core-shell structure.

16. The electrostatic-image developing toner according to claim 1, wherein the toner particles have a shape factor SF1 of 110 to 150.

17. The electrostatic-image developing toner according to claim 1, further comprising 0.01% to 5% by mass of an external additive other than the particles of the metallic salt of the fatty acid.

18. An electrostatic image developer comprising the electrostatic-image developing toner according to claim 1.

19. A toner cartridge attachable to and detachable from an image-forming apparatus, the toner cartridge containing the electrostatic-image developing toner according to claim 1.

* * * * *